United States Patent [19]

Merritt

[11] Patent Number: 4,776,520

[45] Date of Patent: Oct. 11, 1988

[54] ROTARY ATOMIZER

[75] Inventor: James S. Merritt, LaFayette, Colo.

[73] Assignee: Binks Manufacturing Company, Franklin Park, Ill.

[21] Appl. No.: 48,316

[22] Filed: May 11, 1987

[51] Int. Cl.[4] ..... B05B 1/28; B05B 3/10; B05B 5/04

[52] U.S. Cl. ..... 239/700; 239/703; 239/214; 239/223; 239/290; 239/293

[58] Field of Search ..... 239/223, 224, 290, 293, 239/700–703, 214

[56] References Cited

U.S. PATENT DOCUMENTS

| | | | |
|---|---|---|---|
| 1,544,208 | 6/1925 | Bennett | 239/224 X |
| 2,103,887 | 12/1937 | Bowen et al. | 239/223 X |
| 2,711,926 | 6/1955 | Allander | 239/224 |
| 2,752,196 | 6/1956 | Chisholm et al. | 239/224 |
| 3,128,045 | 4/1964 | Gauthier | 239/224 X |
| 4,275,838 | 6/1981 | Fangmeyer | 239/223 |
| 4,337,895 | 7/1982 | Gallen | 239/223 X |
| 4,380,321 | 4/1983 | Culbertson et al. | 239/700 |
| 4,589,597 | 5/1986 | Robisch et al. | 239/703 |
| 4,643,357 | 2/1987 | Culbertson et al. | 239/223 X |

FOREIGN PATENT DOCUMENTS

| | | | |
|---|---|---|---|
| 725083 | 3/1955 | United Kingdom | 239/214 |

*Primary Examiner*—Andres Kashnikow
*Assistant Examiner*—Mary Beth O. Jones
*Attorney, Agent, or Firm*—Juettner Pyle Lloyd & Verbeck

[57] ABSTRACT

A coating applicator has a rotary atomizer detachably mounted directly on a front end of a rotor of an air driven turbine for convenient removal and cleaning of the atomizer. The rotor and atomizer are forward of bearings that rotatably mount a shaft for supporting the rotor, which isolates the bearings from coating material delivered to the atomizer, and turbine exhaust air augments shroud air in shaping the pattern of atomized material.

20 Claims, 3 Drawing Sheets

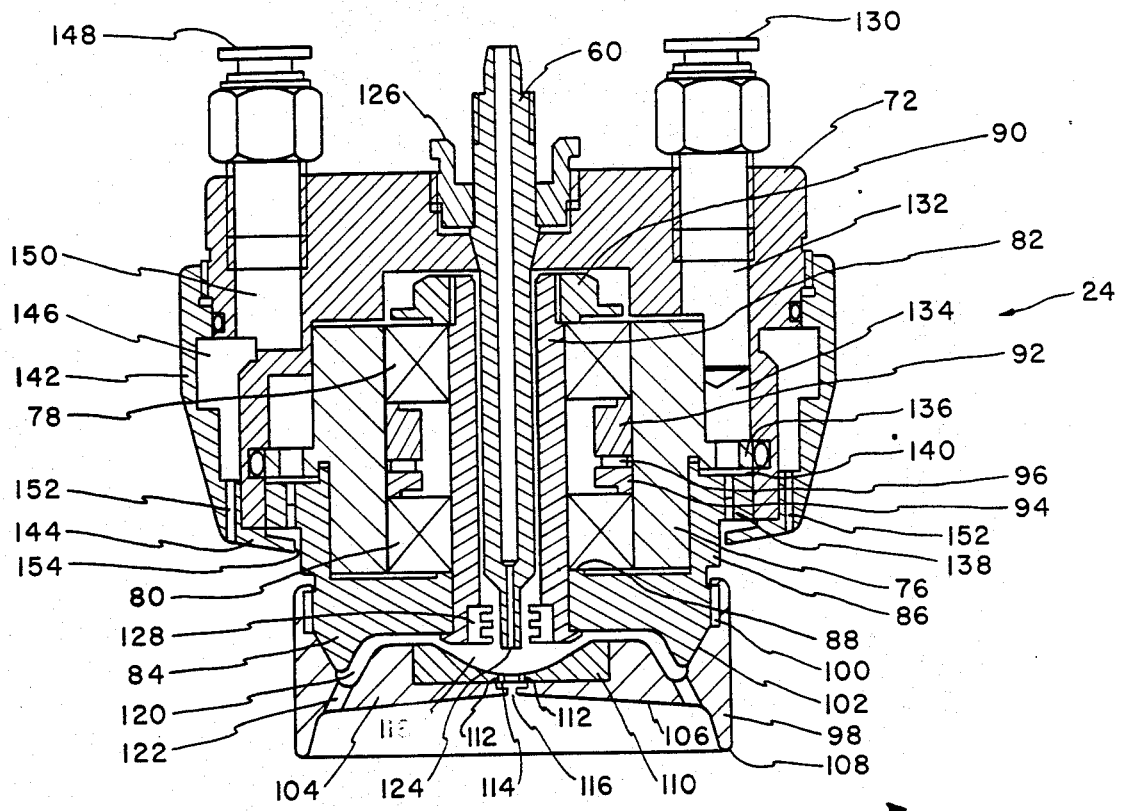
FIG. 3
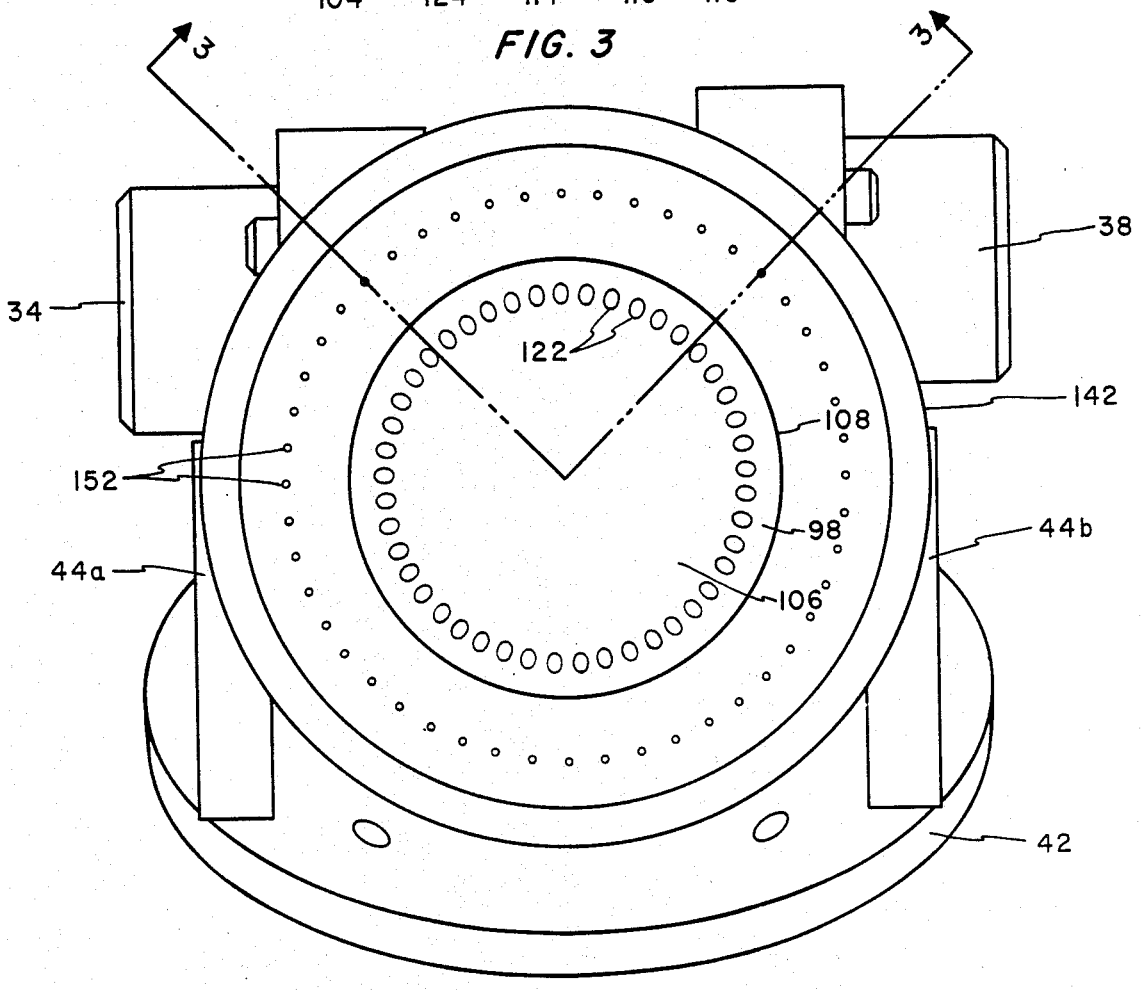

ROTARY ATOMIZER

BACKGROUND OF THE INVENTION

The invention relates to coating apparatus, and in particular to an improved rotary atomizing apparatus for depositing coating material on a workpiece.

Rotary atomizers for applying coating materials such as paint onto articles are known in the art. Conventionally, such a device comprises a rotary bell atomizer carried on an output shaft of an air driven turbine, a rotor of which rotates the shaft and bell. The bell is rotated at high speeds, normally between 4,000 and 60,000 rpm, and paint delivered to a paint feed surface of the rapidly rotating bell is discharged from a peripheral edge of the bell in an atomized spray of small paint particles. The bell is charged to a high voltage, often between 30 KV and 120 KV, to electrostatically charge the paint particles, and the article is grounded, so that the charged paint particles are electrostatically attracted to and coat the article. Usually, a curtain of shroud air flowing around the rotary atomizer aids in shaping the pattern of atomized paint particles and in moving the particles toward the workpiece.

Rotary bell atomizers ordinarily include a front cup-shaped member having a forward paint feed surface across which paint travels to a peripheral discharge edge. Rearwardly of the cup-shaped member is a housing that defines, along with the member, a paint cup on the back side of the member, into which paint is introduced for flow through passages in the member to the forward paint feed surface. During color changes and when the atomizer is to be left idle for a period of time, flush is introduced into the paint cup to clean the atomizer of paint. Nevertheless it sometimes happens that an operator will forget to flush the atomizer when it is to remain idle, with the result that paint dries in the paint cup. Once the paint dries, it cannot readily be removed with flush, so to unclog the atomizer and prevent contamination of subsequent colors of paint, it must be disassembled for manual cleaning. However, conventional rotary atomizers cannot conveniently be disassembled.

In addition, air driven turbines of such coaters are usually located well rearwardly of the atomizer bell, so that the rotor of the turbine is required to turn the bell through a shaft. The arrangement requires a number of often troublesome rotary seals around the shaft between the rotor and bell to prevent paint in the paint cup from flowing back to the turbine. Further, air for driving the turbine is, after use, simply exhausted to atmosphere and wasted.

OBJECTS OF THE INVENTION

An object of the invention is to provide a coating apparatus having a rotary bell atomizer that may readily be removed from the apparatus for manual cleaning.

Another object is to provide such an apparatus in which the atomizer bell is mounted directly on the front of a rotor of an air driven turbine.

A further object is to provide such an apparatus in which the rotor is on a forward side of bearings that rotatably mount a shaft for supporting the rotor.

Yet another object is to provide such an apparatus in which turbine exhaust air is used to augment shroud air in shaping a spray pattern.

SUMMARY OF THE INVENTION

In accordance with the present invention a coating applicator comprises an air driven turbine having a rotor, a rotary atomizer detachably mounted directly on the rotor for rotation therewith, and means for supplying liquid coating material to the rotary atomizer for being emitted from the atomizer in an atomized spray of coating material particles.

In a preferred embodiment, the rotor is at a forward end of the air driven turbine, the rotary atomizer is a rotary bell atomizer having a central generally circular wall defining a forward material feed surface extending to a peripheral discharge edge of the bell, and the bell is mounted on a forward outer circumferential periphery of the rotor with its wall extending across a forward side of the rotor to define a material cup between the wall and rotor. The atomizer bell has passage means extending between the material cup and forward material feed surface, and the supplying means supplies coating material to the material cup for flow through the passage means to and across the material feed surface to the discharge edge for being emitted from the discharge edge in an atomized spray. The rotor is supported for rotation on a shaft, and at least one bearing, located rearwardly of the rotor and atomizer bell, mounts the shaft for rotation. The shaft is tubular and terminates at its forward end at the material cup, and the supplying means includes coating material feed means extending through the shaft to the material cup for introducing coating material into the material cup.

Advantageously, also included is means for generating a generally annular curtain of shroud air flowing forwardly around the discharge edge of the atomizer bell to shape the pattern of atomized spray particles and to carry the particles forwardly of the atomizer bell and toward an article to be coated. In order that air exhausted from the air driven turbine might not be wasted, further included is means for directing turbine exhaust air forwardly in a generally annular curtain around the circular discharge edge to augment the shroud air in shaping the pattern of the atomized spray and in carrying the spray particles toward the article.

Other objects, advantages and features of the invention will become apparent upon a consideration of the following detailed description, when taken in conjunction with the accompanying drawings.

BRIEF DESCRIPTION OF THE DRAWINGS

FIG. 3 is a cross sectional view of an air driven turbine and rotary atomizer of the apparatus, taken along the lines 3—3 of FIG. 4, and FIG. 4 is a front elevation view of the apparatus.

DETAILED DESCRIPTION

Figure 1:
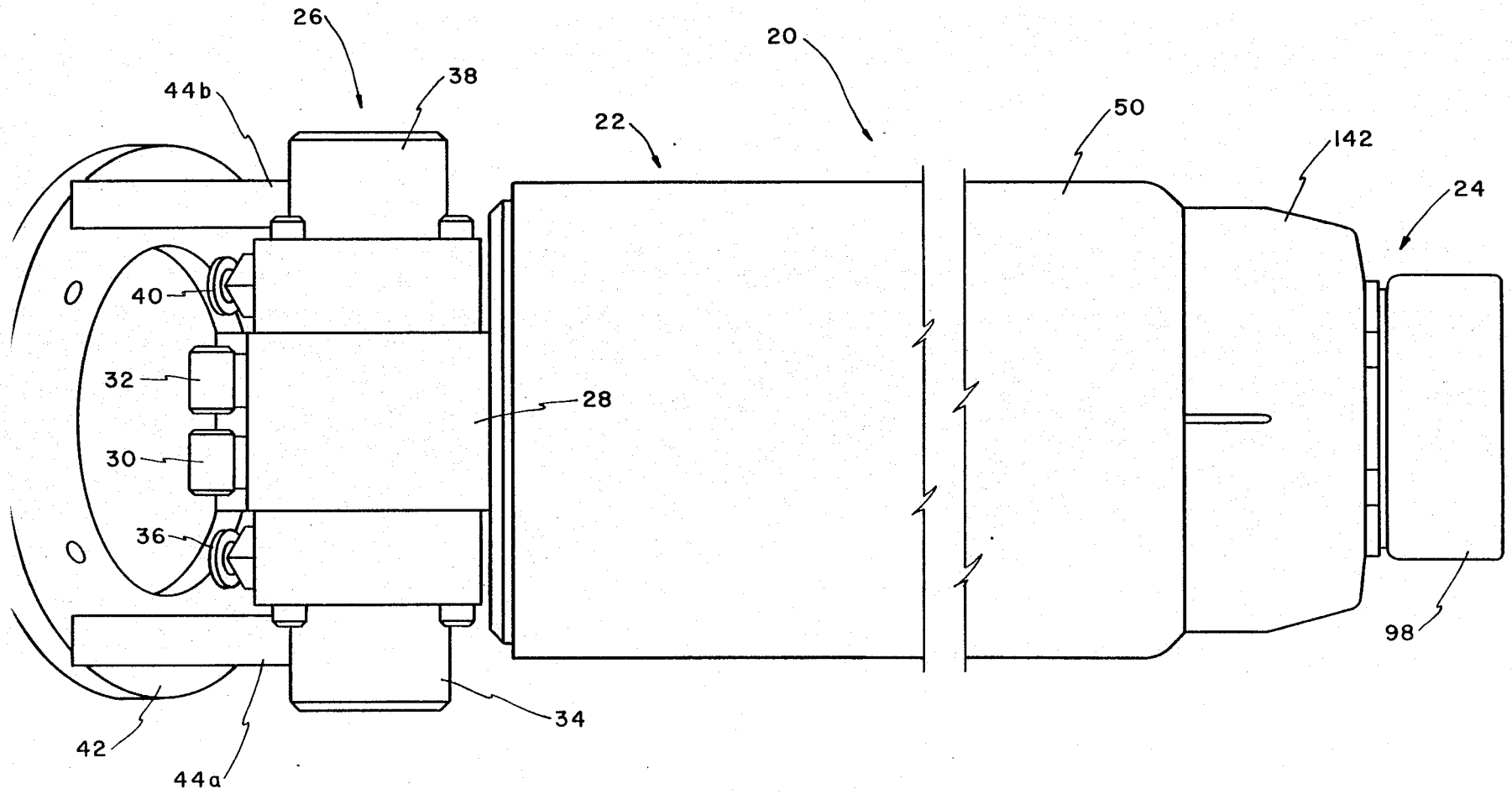
FIG. 1 is a top plan view of a spray coating apparatus embodying the teachings of the present invention.

FIG. 1 illustrates the exterior details of a rotary electrostatic atomizing apparatus 20 with which the teachings of the invention may advantageously be used. The apparatus includes a center body 22 of electrically insulating material, an electrically conductive rotary atomizer assembly 24 at a forward end of the body, and an electrically conductive fluid manifold assembly 26 at a rearward end of the body. The fluid manifold assembly advantageously is of a type as disclosed in U.S. Pat. No.

4,380,321 to Culbertson et al, and includes a valve assembly 28 having a paint/flush inlet 30 connected with supplies of paint and flush (not shown), and a dump outlet 32. A pneumatic paint/flush valve actuator 34 having a control air inlet 36, and a pneumatic dump valve actuator 38 having a control air inlet 40, are connected with the valve assembly for controlling valves therein, such that during spray coating of an article, paint supplied at the inlet 30 is connected to the rotary atomizer assembly 24. Then, during a flushing operation to clean the apparatus of paint, at which time flush is supplied to the inlet 30, the valve actuators 34 and 38 are operated to connect the inlet 30 to the dump outlet 32 to rapidly flush paint from the supply line and valve assembly, and to then briefly connect flush at the inlet with the rotary atomizer to clean it also. The spraying apparatus is adapted to be mounted on a support for automatic operation, and for the purpose includes a mounting ring 42 connected to the fluid manifold assembly by a pair of brackets **44*a* and 44*b***.

Figure 2:
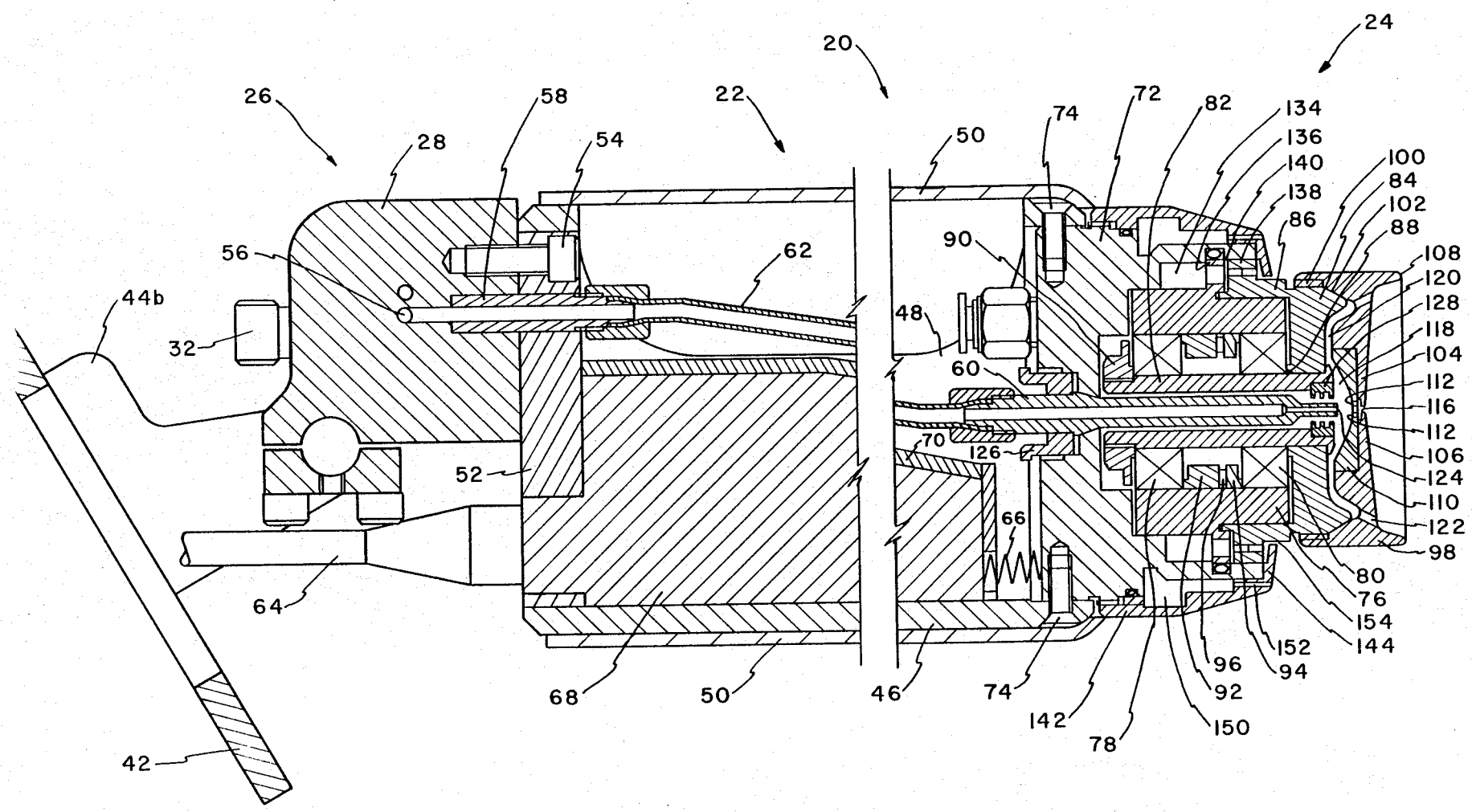
FIG. 2 is a cross sectional side elevation view of the coating apparatus.

Referring to FIG. 2, the center body 22 comprises a support tube 46 of electrically insulating PVC material, cut away at 48 to define an access opening to the tube. Surrounding the tube is an outer tubular cover 50 of electrically insulating polyethylene, and carried at and closing a rearward end of the support tube is a bulkhead 52 of aluminum. The bulkhead is mounted on the forward end of the valve assembly 28 by a plurality of fasteners 54 (only one of which is shown), and extending through the bulkhead and into conmunication with a fluid outlet passage from the valve assembly is a metal fluid outlet tube 58. Connecting the fluid outlet tube and a fluid inlet 60 to the rotary atomizer assembly 24 is a fluid line 62 of electrically insulating teflon.

The apparatus 20 electrostatically charges atomized spray particles emitted from the rotary atomizer assembly 24, and for the purpose a power cable 64 extends through the bulkhead 52 into the support tube 46. The power cable may carry a high d.c. voltage on the order of 30–120 KV, in which case it would extend through the support tube into contact with one end of a metal coil spring 66, an opposite end of which connects with the rotary atomizer assembly. On the other hand, the power cable advantageously may carry a low d.c. voltage on the order of 24 volts. In this case, it would be connected to an input to a suitable cascade generator or voltage multiplier circuit (not shown) potted in an electrically insulating material 68 covered by a Delrin housing 70, with an output from the circuit being connected to the one end of the coil spring.

Referring also to FIGS. 3 and 4, except for seals, the components of the rotary atomizer assembly 24 are electrically conductive, and include a main housing 72 mounted at a forward end of the support tube 46 by a plurality of fasteners 74. A bearing housing 76 is coaxially within and sealed to a forward end of the main housing, and a rear bearing 78 and front bearing 80 are in a passage through the bearing housing. The bearings support a tubular shaft 82, on a forward end of which is a rotor 84 of an air driven turbine. The rotor has an outer rearwardly extending cylindrical portion 86 that closely surrounds a forward end of the bearing housing and a center rearwardly extending annular shoulder 88 that engages the bearing 80. A nut 90 is threaded onto a rearward end of the shaft, and between the bearings are an annular insert 92 and spacer 94 that are urged apart and against the bearings by a wave spring 96 to preload the bearings.

The atomizer assembly 24 also includes an atomizing device which may be a rotary disc or, as shown, a cup-shaped rotary atomizer bell 98 mounted directly on the forward circumferential periphery of the rotor 84 and across, sealed with and centered with respect to a forward end of the rotor by threads 100 on and tapered surfaces 102 between the rotor and bell. The bell is rapidly rotated by the rotor and has a front wall 104 defining a forward paint feed surface 106, across which paint flows in a thin film under centrifugal force to a peripheral discharge edge 108 for being projected from the edge in a spray of finely atomized particles. A restricter 110 is in an annular recess in the rear surface of the wall, and a pair of passages 112, diametrically offset from the axis of the bell, extend through the restricter into a circular chamber 114, from which chamber a passage 116 opens onto the axial center of the paint feed surface. The passages allow thorough flushing of the entirety of the paint feed surface, as described in Culbertson et al U.S. Pat. No. 4,643,357, the teachings of which are incorporated herein by reference.

A paint cup 118 is defined between a domed rear side of the restricter 110 and a forward end of the rotor shaft 82 and rotor 84, and an annular passage 120 between the rotor and bell front wall 104 leads from the paint cup to a circular array of passages 122 extending through the wall and opening onto the paint feed surface 106, so that paint may flow from the paint cup to the paint feed surface for being emitted from the bell in a spray. To supply paint to the paint cup, the fluid inlet 60 extends axially through the main housing 72 and tubular shaft 82 and terminates in an orifice 124 that directs a stream of paint axially into the paint cup. A retainer 126 secures the fluid inlet in the main housing, and a labyrinth seal 128, in a forward end of the shaft, closely surrounds the orifice to inhibit a flow of paint from the paint cup to between the fluid inlet and shaft.

To impart rotation to the rotor 84 and atomizer bell 98, a turbine air inlet 130 connects through a passage 132 in the main housing 72 to an annular passage 134 defined between the main housing, a cylindrical surface of the bearing housing 76 and a radially extending annular jet plate 136 of the bearing housing. A rearward surface of a radially extending annular turbine flange 138 of the rotor is closely juxtaposed to a forward surface of the jet plate to define a narrow annular space 140 therebetween, and four passages extend through the jet plate at about 90° apart and at about 30° from back to front in the direction of rotation of the rotor. The rotor turbine flange 138 has about 30–40 equally spaced passages extending from the space 140, at about 30° in the direction of rotation of the rotor, to about halfway through the flange, whereat the passages make about a 90° bend and open onto a forward surface of the flange at about 60° against the direction of rotation of the rotor. Consequently, air under pressure at the turbine air inlet flows through the jet plate and rotor flange passages and imparts a high speed of rotation to the rotor and atomizer bell that normally ranges from about 4,000–60,000 rpm.

Because of the high d.c. voltage applied to the rotary atomizer assembly 24, atomized paint particles projected from the peripheral edge 108 of the bell 98 are electrostatically charged and attracted toward a grounded article positioned forwardly of the bell. However, the high rate of rotation of the bell causes paint particles leaving the discharge edge to travel generally radially away from the bell. To assist movement of the paint particles toward and to the article, rotary electrostatic spray coating systems of the general type therefore usually direct an annular curtain of air forwardly around and in surrounding relationship to the bell to carry the paint particles toward the article. To generate the air curtain, the atomizer assembly also has a shroud air ring 142 threaded at its rearward end onto the main housing 72, extending forwardly around the housing and terminating at its forward end in a radially inwardly extending annular lip 144. An annular passage 146 between the shroud air ring and main housing is coupled to a shroud air inlet 148 by a main housing passage 150, and a plurality of shroud air outlet passages 152, in a circular array outwardly of the circumference of the atomizer bell, extend between the passage 146 and a front surface of the lip. Consequently, air at the shroud air inlet flows through the passages 152 and generates a forwardly moving annular curtain of shroud air around the bell to shape the spray pattern and carry atomized paint particles toward the article to be coated. At the same time, because the shroud air lip extends across the forward surface of the rotor turbine flange 138, air exhausted from the turbine through the rotor flange passages flows through an annular space between an inner end 154 of the lip and the rotor 84, and then forwardly in an annular curtain around the bell to augment the shroud air in shaping the spray pattern and moving paint particles toward the article.

The invention therefore provides an improved rotary electrostatic spray coating apparatus. Although the atomizer bell 98 and paint cup 118 may normally be cleaned with flush, because the bell is threadably attached directly onto the front of the rotor 84, it may conveniently be removed for manual cleaning of its interior. In this connection, it is to be appreciated that the tapered surfaces 102 on the rotor and bell, in addition to providing an annular liquid seal around the paint cup outwardly of the passages 122, also accurately center the bell on the rotor. Because of the high speeds of rotation of the rotor and bell, unless the bell is accurately balanced on the rotor destructive vibrations will occur, and the tapered surfaces ensure that balance is maintained when the bell is threaded back onto the rotor after cleaning. Also, since the rotor is immediately behind and mounts the bell, as compared with rotating the bell through a shaft, troublesome rotary seals are not required around the shaft to prevent paint in the paint cup from flowing rearwardly to the turbine. In addition, as compared with simply discharging turbine exhaust air, the exhaust air advantageously is used to augment the shroud air to minimize system air requirements.

To minimize shock hazards, it is desirable that the mounting ring 42 and support to which it is attached be electrically grounded. However, if paint being sprayed is electrically conductive, grounding the mounting ring will cause excessive leakage current to flow between the mounting ring and atomizer assembly 24 through the column of paint in the fluid line 62, resulting in an unacceptable decrease in electrostatic charging efficiency. Consequently, it also is contemplated that the fluid manifold assembly 26 may be at the forward end of the center body 22 between the center body and atomizer assembly, and the mounting ring attached to the rearward end of the center body. In this case, the high charging voltage would be coupled to the atomizer assembly through the fluid manifold assembly, while the center body maintains electrical isolation between the charging voltage and mounting ring.

While embodiments of the invention have been described in detail, various modifications and other embodiments thereof may be devised by one skilled in the art without departing from the spirit and scope of the invention, as defined in the appended claims.

What is claimed is:

1. A coating applicator, comprising an integral cup-shaped rotor having a generally circular front wall and an annular side wall extending rearwardly from said front wall and defining a turbine member; a shaft mounting said rotor at a front end of said shaft and substantially entirely at a front end of said applicator with said rotor side wall extending rearwardly from said applicator front end; means supporting said shaft for rotation with said rotor; means for directing a flow of air to said turbine member to cause rotation of said rotor; a rotary atomizer detachably mounted directly on said rotor and across said rotor front wall for rotation with said rotor; and means for supplying liquid coating material to said rotary atomizer for being emitted from said atomizer in an atomized spray of coating material particles.

2. A coating applicator as in claim 1, wherein said rotary atomizer has a forward material feed surface extending radially outwardly to a peripheral coating material discharge edge, said atomizer and rotor front wall define a material cup therebetween, said atomizer has passage means extending between said material cup and said material feed surface, and said supplying means delivers coating material to said material cup for flow through said passage means to and across said material feed surface to said discharge edge for being emitted from said discharge edge in an atomized spray.

3. A coating applicator as in claim 2, wherein said rotary atomizer and rotor are in sealed relationship outwardly of and around said material cup by mating tapered surfaces on said atomizer and rotor.

4. A coating applicator as in claim 2, wherein said rotary atomizer is detachably threadably mounted on a forward outer circumferential periphery of said rotor front wall and said atomizer and rotor are in sealed relationship outwardly of and around said material cup by mating tapered surfaces on said atomizer and rotor.

5. A coating applicator as in claim 2, wherein said supporting means includes at least one bearing mounting said shaft for rotation, said at least one bearing mounting said shaft rearwardly of said rotor and rotary atomizer.

6. A coating applicator as in claim 5, wherein said shaft is tubular and terminates at its forward end at said material cup, and said supplying means includes coating material feed means extending through said shaft to said material cup for introducing a stream of coating material into said material cup, and seal means at said forward end of said shaft for providing a liquid seal between said shaft and coating material feed means.

7. A coating applicator as in claim 1, wherein said rotary atomizer is detachably threadably mounted on said rotor forward end.

8. A coating applicator as in claim 1, wherein said rotary atomizer is a rotary bell atomizer having a generally circular central wall defining a forward material feed surface extending to a peripheral discharge edge of said bell, said bell is mounted on a forward outer circumferential periphery of said rotor front wall with said central wall extending across said rotor front wall and defining a material cup between said central wall and rotor front wall, said central wall has passage means extending between said material cup and forward material feed surface, and said supplying means delivers coating material to said material cup for flow through said passage means to and across said material feed surface to said discharge edge for being emitted from said discharge edge in an atomized spray.

9. A coating applicator as in claim 1, wherein said rotor turbine member comprises an annular turbine flange toward a rearward end of said rotor side wall and said turbine flange has a plurality of air flow passages therethrough, and said air flow directing means comprises an annular jet plate, having a plurality of air flow passages therethrough, closely juxtaposed to but spaced from said turbine flange, and means for supplying air under pressure to said jet plate passages for flow through said jet plate and turbine flange passages to cause rapid rotation of said rotor upon a flow of air through said passages.

10. A coating applicator as in claim 9, wherein said rotary atomizer has a circular peripheral coating material discharge edge from which coating material is emitted in an atomized spray of coating material particles, and including means for directing a generally annular curtain of shroud air forwardly around said circular discharge edge to shape the pattern of the atomized spray and carry the spray particles forwardly of said rotary atomizer and toward an article to be coated.

11. A coating applicator as in claim 10, further including means for directing air flowing out of said rotor turbine flange passages forwardly in a generally annular curtain around said circular discharge edge to augment said shroud air in shaping the pattern of the atomized spray and in carrying the spray particles forwardly of said rotary atomizer and toward the article.

12. A coating applicator as in claim 1, wherein said rotary atomizer is of an electrically conductive material, and including means for applying a high d.c. voltage to said rotary atomizer to electrostatically charge the atomized spray of coating material particles.

13. A coating applicator assembly, comprising a generally annular bearing housing having an axial passage therethrough; a shaft extending through said bearing housing passage; at least one bearing in said bearing housing passage supporting said shaft for rotation; a rotor mounted on said shaft forwardly of both said bearing housing and said at least one bearing, said rotor having a generally circular forward end, an outer cylindrical portion extending rearwardly from said forward end and around said bearing housing, and an annular turbine flange extending from said cylindrical portion and having a plurality of air flow passages therethrough; an annular jet plate having a plurality of air flow passages therethrough, said jet plate being closely juxtaposed to but spaced from said turbine flange; means for supplying air under pressure to said jet plate passages for flow through said jet plate and turbine flange passages to cause rapid rotation of said rotor upon a flow of air through said passages; a rotary atomizer detachably mounted directly on said rotor forward end and extending forwardly of said rotor; and means for supplying liquid coating material to said rotary atomizer for being emitted from said atomizer in an atomized spray of coating material particles.

14. A coating applicator assembly as in claim 13, wherein said rotary atomizer has a forward material feed surface extending radially outwardly to a peripheral discharge edge from which coating material is emitted in an atomized spray, said atomizer extends across a forward end of said rotor and said atomizer and rotor define a material cup therebetween, said atomizer has passage means extending between said material cup and said material feed surface, and said supplying means delivers coating material to said material cup for flow through said passage means to and across said material feed surface to said discharge edge.

15. A coating applicator assembly as in claim 14, wherein said rotary atomizer and rotor are in sealed relationship outwardly of and around said material cup by mating tapered surfaces on said atomizer and rotor.

16. A coating applicator assembly as in claim 14, wherein said rotary atomizer is detachably threadably mounted on a circumferential periphery of said rotor forward end.

17. A coating applicator assembly as in claim 14, wherein said shaft is tubular, and said supplying means includes coating material feed means extending through said shaft to said material cup for introducing a stream of coating material into said material cup.

18. A coating applicator assembly as in claim 14, wherein said rotary atomizer peripheral discharge edge is circular, and including means surrounding said bearing housing, jet plate and rotor turbine flange for directing a generally annular curtain of shroud air forwardly around said discharge edge to shape the pattern of the atomized spray and to carry the spray particles forwardly of said rotary atomizer and toward an article to be coated.

19. A coating applicator assembly as in claim 18, wherein said means for directing further includes means for directing air flowing out of said rotor turbine flange passages in a generally annular curtain forwardly around said discharge edge to augment said shroud air in shaping the pattern of the atomized spray and in carrying the spray particles forwardly of said rotary atomizer.

20. A coating applicator assembly as in claim 13, wherein said rotary atomizer is of an electrically conductive material, and including means for applying a high d.c. voltage to said atomizer to electrostatically charge the atomized spray of coating material particles.

* * * * *